US006913173B2

(12) United States Patent
Manini

(10) Patent No.: US 6,913,173 B2
(45) Date of Patent: Jul. 5, 2005

(54) METHOD AND APPARATUS FOR OPENING, POSITIONING AND LOADING SOCKS ON FORMS

(75) Inventor: Benito Manini, Florence (IT)

(73) Assignee: Matec S.p.A., Scandicci (IT)

( * ) Notice: Subject to any disclaimer, the term of this patent is extended or adjusted under 35 U.S.C. 154(b) by 196 days.

(21) Appl. No.: 10/257,020

(22) PCT Filed: Mar. 21, 2001

(86) PCT No.: PCT/IB01/00443

§ 371 (c)(1),
(2), (4) Date: Jan. 23, 2003

(87) PCT Pub. No.: WO01/77432

PCT Pub. Date: Oct. 18, 2001

(65) Prior Publication Data

US 2003/0146253 A1 Aug. 7, 2003

(30) Foreign Application Priority Data

Apr. 7, 2000 (IT) ..... PI2000A0027

(51) Int. Cl.[7] ..... D06C 5/00
(52) U.S. Cl. ..... 223/75
(58) Field of Search ..... 223/75

(56) References Cited

U.S. PATENT DOCUMENTS 4,463,340 A * 7/1984 Adkins et al. ..... 307/10.4

FOREIGN PATENT DOCUMENTS

| | | |
|---|---|---|
| EP | 0878573 A2 | 5/1998 |
| GB | 2181465 A | 9/1986 |

* cited by examiner

*Primary Examiner*—John J. Calvert
*Assistant Examiner*—James G Smith
(74) *Attorney, Agent, or Firm*—Simpson & Simpson, PLLC

(57) ABSTRACT

An apparatus for automatic loading socks on forms (1) comprises a suction unit (20) at the entry, a carousel (10) with several stations, a sock positioning unit (30), a sock tucking up unit (40) and a withdrawing and loading robot (50). The carousel has heads (11) carrying elongated supports (12) on which socks (2) are put partially or completely. The heads (11) rotate integrally to the carousel (10) carrying the elongated supports (12) through four following stations and respectively a station at the entry (2) for opening the socks and putting them onto the elongated supports (12), a positioning station (3), a tucking up station (4) and a withdrawing station (5). The socks are widened at the entry by means of suction counter rotating rollers, whereas the tucking up step is carried out by means of tangential friction rollers counter rotating and the loading step is carried out by means of a two stations robot with arms capable of raising and lowering as well as of rotating to load the socks on the steaming forms, by means of fingers that are widened and then approached with respect to each other.

19 Claims, 8 Drawing Sheets

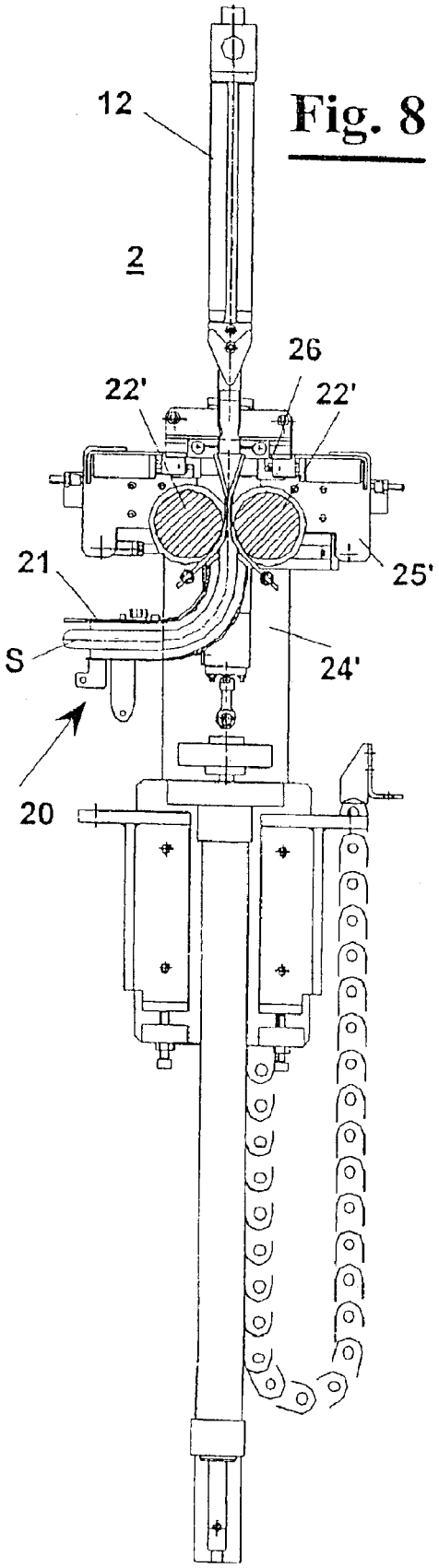
Fig. 8
Fig. 9
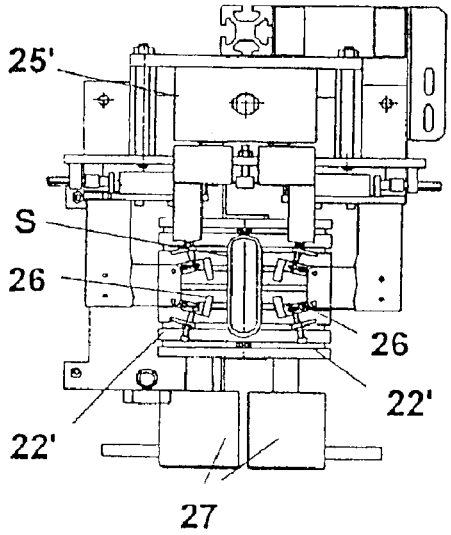
Fig. 10
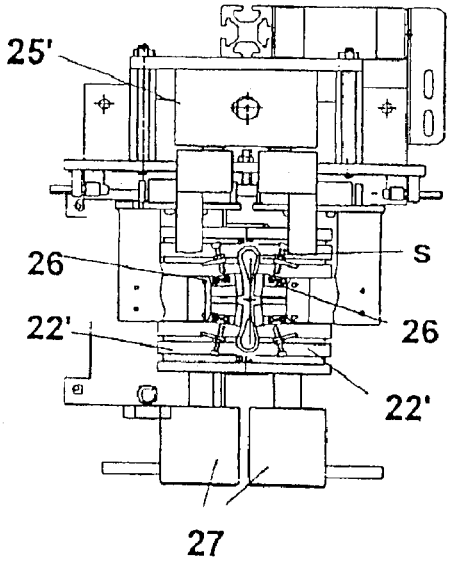

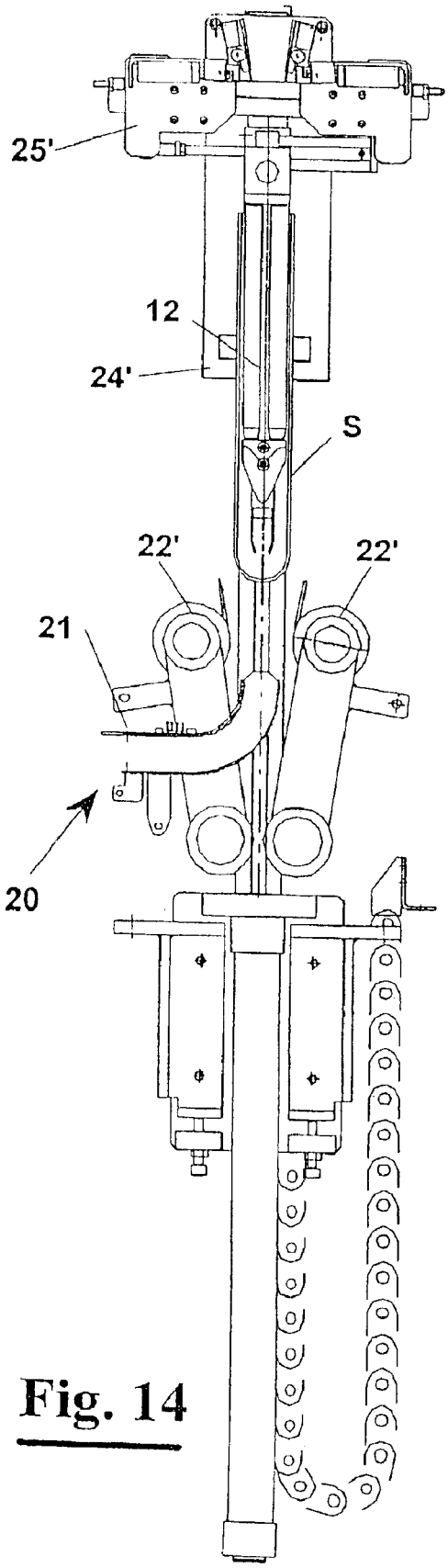
Fig. 14
Fig. 15
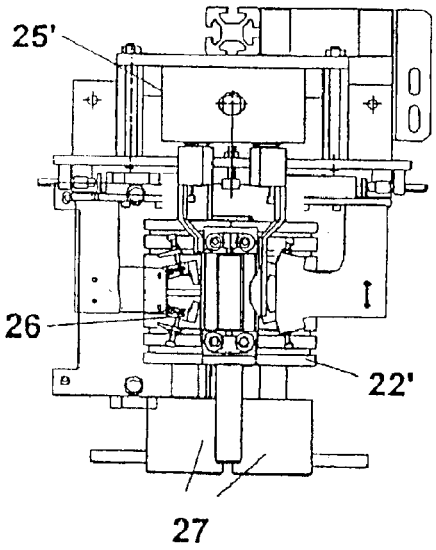

METHOD AND APPARATUS FOR OPENING, POSITIONING AND LOADING SOCKS ON FORMS

FIELD OF THE INVENTION

The present invention relates to a method for opening, positioning, loading on steaming forms hosiery articles such as socks, knee socks and the like. The method is used for example in automatic steaming lines of such articles.

Furthermore the invention relates to an apparatus that carries out this method. In particular, the invention relates to a machine with a pick-up unit of the articles to process, a unit for opening the articles, a unit for their correct positioning with respect to the steaming forms and an automatic loading unit of the articles on the forms.

DESCRIPTION OF THE PRIOR ART

Loading socks or knee socks on steaming machines, differently from stockings that are tubular, is not carried out automatically but manually, owing to the problem of the correct loading the articles onto the flat steaming forms. In fact, a sock is axially asymmetrical for the shape of the foot and of the heel, whereas a knee sock has a terminal seam along a curve. In both cases they have to be loaded in order to lay in the plane of the form.

The problem of automatic loading socks on steaming forms has been overcome in part in EP0878573, where the socks are introduced in a suction tube with elasticised open edge oriented forwards and foot backwards. The tube brings the socks between two rollers coated of a friction fabric, which open the elasticised open edge in order to put it on a widening tool. This tool widens a sock that is put on it and withdraws thus loading it on an elongated support, leaving the foot hanging down. Then, the elongated support is rotated up to a vertical Position, so that the foot that hangs is aligned for gravity. Then, air is blown through the elongated support in order to inflate the foot of the sock.

By means of friction tangential rollers the sock is rotated axially so that a portion of the inflated foot that protrudes radially is detected by a photocell, and then it is stopped in a predetermined angular position, whichever were its starting position. This angular position coincides with that of the form, which is positioned above and is lowered so that it enters the correctly oriented sock. The form, moreover, is raised and carried away, for example in a steaming apparatus, with the sock on it correctly located.

The apparatus according to the prior art, even if it is able to carry out the above operations, does not allow high production rates. In particular, a sock loading cycle is conditioned by the sum of the time required for the following single operations: rotation of the support from the horizontal to the vertical position, axial rotation with blow of air, lowering the shape and raising it, as well as backward rotation of the support for receiving a sock.

Furthermore the conventional steaming machines have all the steaming forms oriented towards the above. The apparatus described, instead, has forms that enter in the sock oriented towards below. For this reason, a special steaming machine is necessary that either have steaming forms oriented towards below or complex systems of rotation of the forms. In any case, there is not the possibility of "retrofitting" the existing steaming machines by means of the above described loading apparatus, owing to both the high cycle time and the solution of loading the socks onto forms oriented towards below.

SUMMARY OF THE INVENTION

It is therefore object of the present invention to provide a method of loading socks and knee socks on steaming forms that allows a cycle time that is substantially lower than in the apparatus of prior art.

It is another object of the present invention to provide a method of loading socks and knee socks on a steaming machine that has forms oriented towards the above.

It is still another object of the present invention to provide an apparatus that carries out this method.

It is furthermore object of the present invention to provide an apparatus that is substantially different from the prior art and solves the technical problems as described above.

In the following description reference is made to loading socks, being it clear that the same concept can be extended to loading knee socks and other similar articles for which an orientation is necessary before loading them onto the forms.

According to a main aspect of the invention, the socks, after having been picked up, are loaded on elongated supports making part of a carousel with at least two stations, one of which is a axial positioning station of the sock, and the other is a loading/unloading station of the sock.

This way, the cycle time is half of the system according to the prior art. In fact, while a sock is positioned, another sock can be withdrawn from the elongated support and loaded on the forms.

For making the steps of loading/unloading the socks on the elongated supports independent from each other, at least three stations can be provided, on each station a sock on a respective elongated supports being present. In one station the picked up socks are open and put onto the elongated supports, in another station the positioning step is carried out and in a third station the positioned socks are withdrawn and loaded on the forms.

Preferably, the step of widening the socks at the entry is carried out by means of passage through widening rollers that bring them up to a vertical position from below towards the above. This way the elongated supports in the station of entry can be vertical and their rotation from horizontal to vertical is not necessary.

Advantageously, between the positioning station and the withdrawing and loading station, the elongated supports are rotated of 180° with respect to an horizontal axis, so that the sock has foot towards the above and it can be loaded on forms oriented towards the above.

After the positioning station, the socks are advantageously tucked up, i.e. put completely onto, the elongated supports so that the foot does not hang towards below. To this end, a tucking up station is provided set between the positioning station and the withdrawing and loading station.

The widening step of the socks and the step of putting them on the elongated supports is carried out preferably in the station of entry where, at the end of a sucking duct two suction counter rotating rollers are provided. The elasticised open edges of the sock that pass between the suction counter rotating rollers are pulled towards opposite directions by the suction air and then are widened by an enlarging tool that brings also the sock towards the above putting it on the elongated support, which is arranged in co-axial position.

Alternatively, the widening step of the socks and the step of putting them on the elongated support is carried out always at the end of a suction duct where two counter rotating rollers are provided. The elasticised open edges of the sock that exit the rollers are picked up in opposite directions by a couple of tweezers facing each other that open the sock so that an enlarging tool brings the sock towards the above putting it on the elongated support, which is arranged in co-axial position. This solution avoids that socks not oriented correctly, i.e. whose elasticised open edge is not oriented forwards, are accepted, since the tweezers fail to open the foot or tip, and this can be detected so that such misoriented socks are sent back for being oriented correctly.

Advantageously, the suction duct of the station of entry has a vertical terminal portion and the rollers pinch the sock when it moves from below towards the above, whereby the elongated support that receives the socks is already in a vertical position when the socks are put on it.

In the positioning station, an air flow preferably crosses the elongated support from the above towards below, thus inflating the sock. Then, the inflated sock is rotated about a vertical axis and sensor means detect when the inflated foot, that extends radially asymmetrically with respect to the vertical axis, has reached a predetermined angular position that corresponds to an angular position aligned to the steaming forms in the loading step.

In the tucking up station, the socks oriented are pushed towards the above onto the elongated supports so that only a short portion of the foot or tip hangs from them. This is carried out by means of at least a couple of friction rollers that rotate pushing the sock towards the above.

The withdrawing and loading step of the socks from the elongated support is, carried out preferably in a station where a robotized equipment is provided formed by at least two arms opposite to each other at 180° and mounted on an upright guide rotatable about its own vertical axis. The arms can translate vertically upwards or downwards along the upright guide and can rotate about an horizontal axis. At the end the arms have withdrawing fingers capable: of entering between the sock and the elongated support, of widening and then, brought towards the above by arms, of withdrawing the sock from the elongated support. Then, the upright guide rotates of 180° with respect to its own vertical axis and the sock that is widened by the fingers can be loaded on the steaming forms by means of the rotation of the corresponding arm about an horizontal axis.

BRIEF DESCRIPTION OF THE DRAWINGS

Further characteristics and the advantages of the method and of the apparatus according to the present invention, for opening, positioning, loading on forms socks, knee socks and the like, will be made clearer with the following description of an embodiment thereof, exemplifying but not limitative, with reference to the attached drawings wherein:

FIGS. 8 and 9 show respectively an elevational view and a top plan view of a preferred embodiment of a tweezers opening device of the socks that have to be loaded on the supports;

FIGS. 10, 11, 13, 15 show a top plan view of the device for opening the socks of FIGS. 8 and 8A in four different operative positions;

FIGS. 12 and 14 show an elevational view of the device for opening the socks of FIGS. 8 and 8A in two different operative positions.

DESCRIPTION OF THE PREFERRED EMBODIMENT

Figure 1:
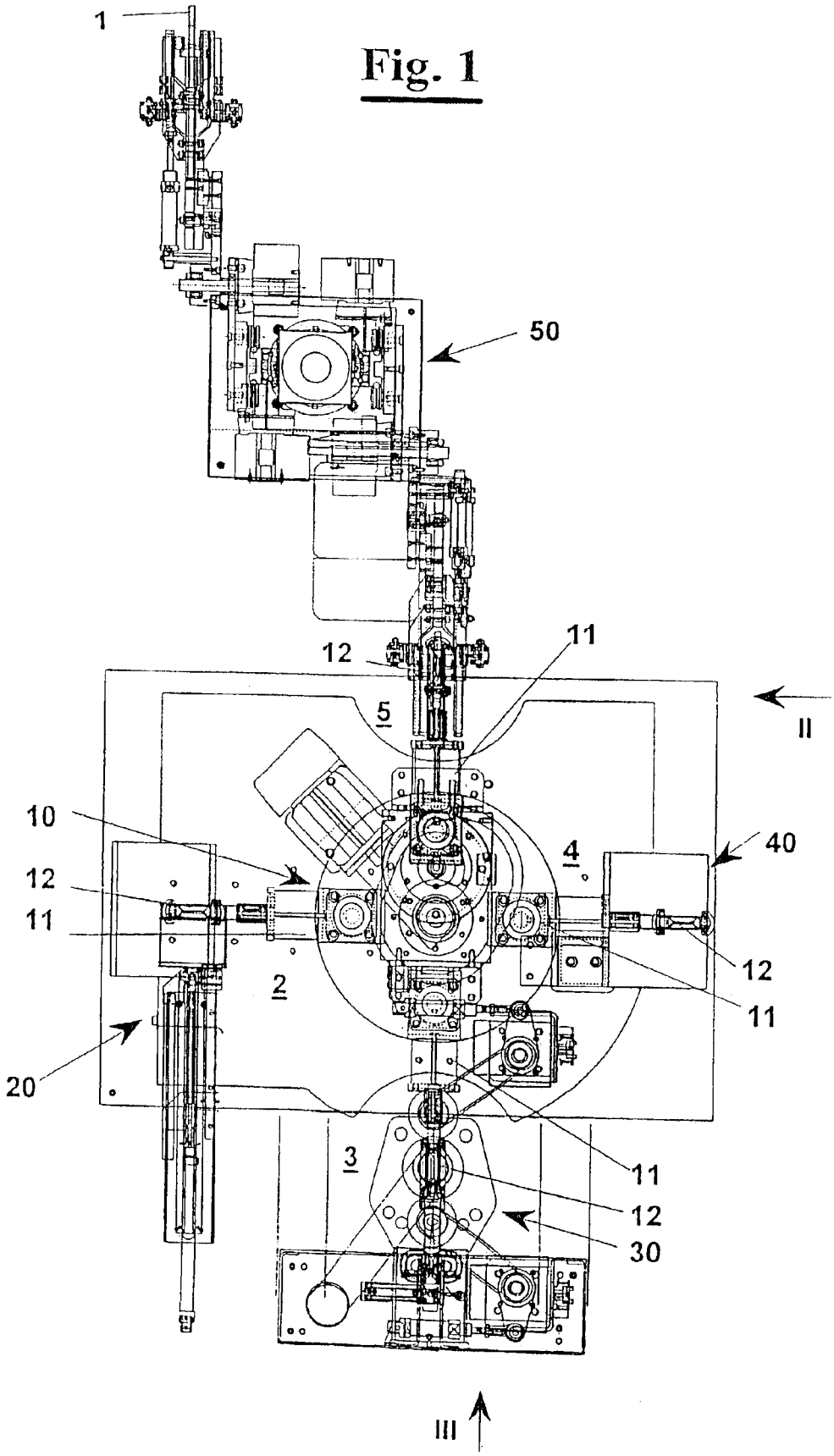
FIG. 1 shows a top plan view of an apparatus according to the invention with four stations and a pick-up and loading unit with two stations.

With reference to FIGS. from 1 to 3, an apparatus for automatic loading socks on forms 1 comprises a suction tube unit 20 at the entry, a carousel 10 having four stations, a sock positioning unit 30, a tucking up unit 40 and a withdrawing and loading robot 50.

The carousel 10 has four heads 11 carrying elongated supports 12 on which socks can be put partially or completely.

Heads 11 rotate integrally to carousel 10 carrying the elongated supports 12 through four following stations and respectively a station at the entry 2, a positioning station 3, a tucking up station 4 and a withdrawing station 5.

Figure 4:
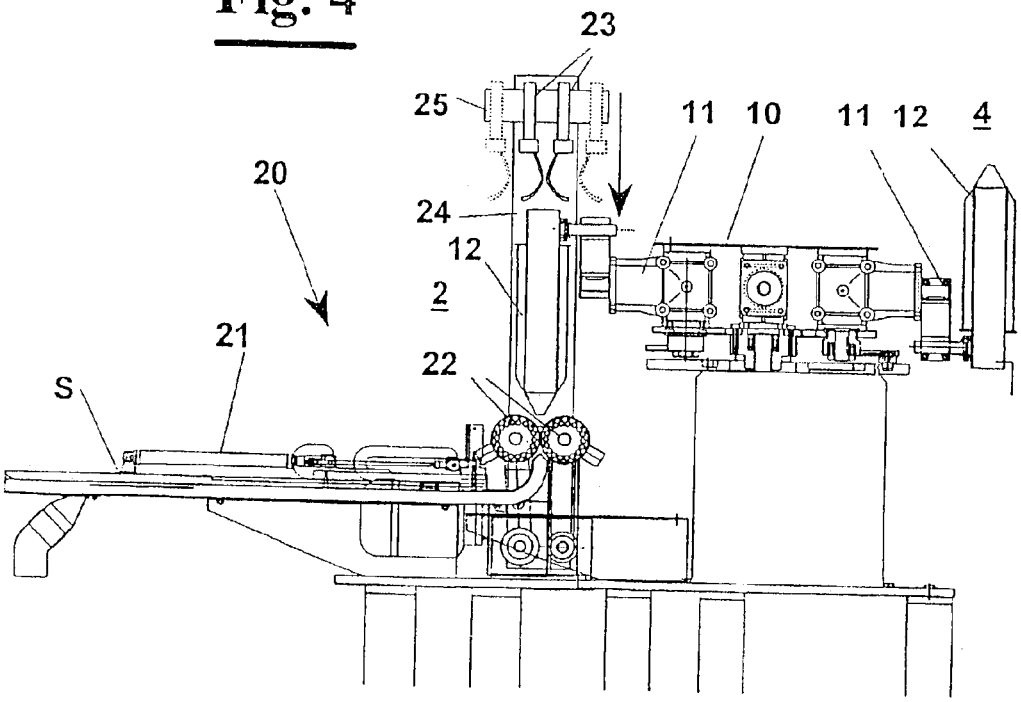
FIG. 4 shows an elevational view of the socks entry and widening unit of the apparatus of FIGS. from 1 to 3.

In the station at entry 2 a sock S, whose elasticised open edge is oriented forwards and foot or tip backwards, is dragged by a suction tube 21 (FIG. 4). Tube 21 brings sock S between two air, suction rollers 22, which open the sock elasticised open edge in order to put it on a widening tool 23. Widening rollers 22 and widening tool 23 carry the socks directly up to a vertical position from below towards the above. This way there is the advantage that the elongated supports 12 in the station at entry 2 can be vertical and a rotation thereof prom horizontal to vertical is not necessary.

Widening tool 23 is widened on sock S put on it and withdraws towards the above on a guide 24 mounted on a carriage 25, thus loading it on an elongated support 12, leaving the foot P free of hanging towards below in positioning station 3.

Figure 3:
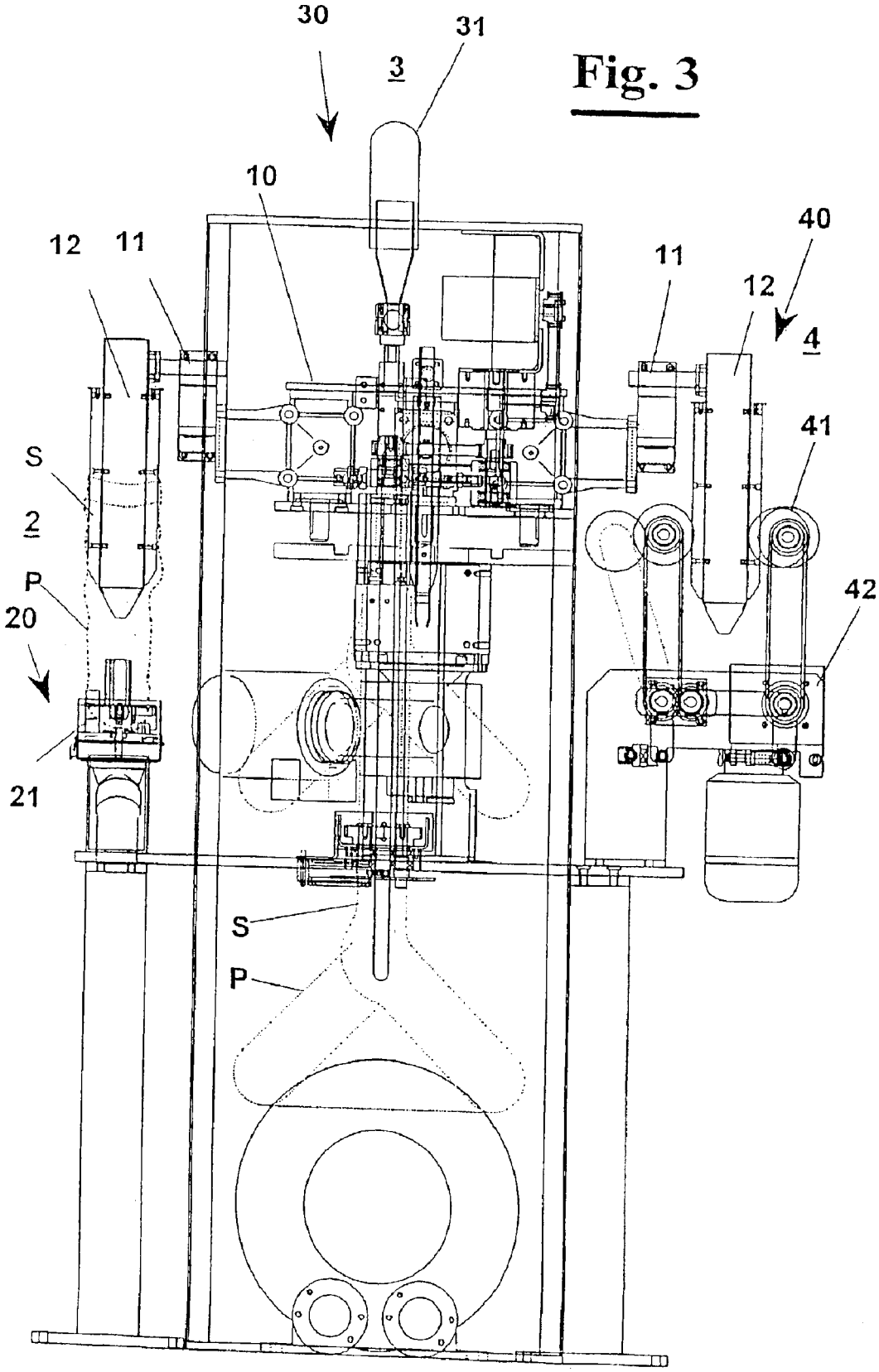
FIG. 3 shows an elevational view according to arrow III of the apparatus of FIG. 1.

In positioning station 3 (FIG. 3), after that carousel 10 has rotated 90°, positioning unit 30 blows air through a tube 31 through elongated support 12 in order to inflate the foot P of sock S.

Figure 2:
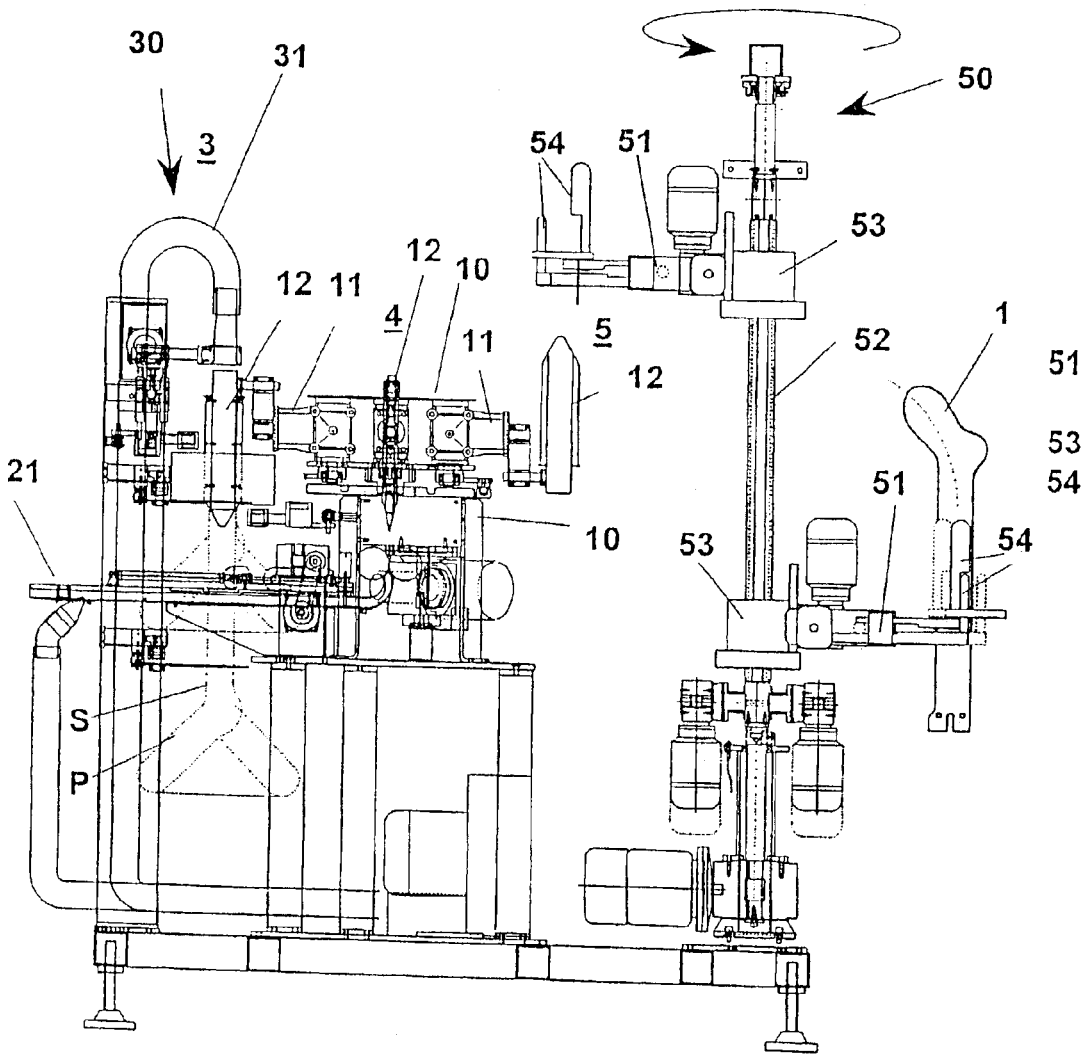
FIG. 2 shows an elevational view according to arrow II of the apparatus of FIG. 1.
Figure 5:
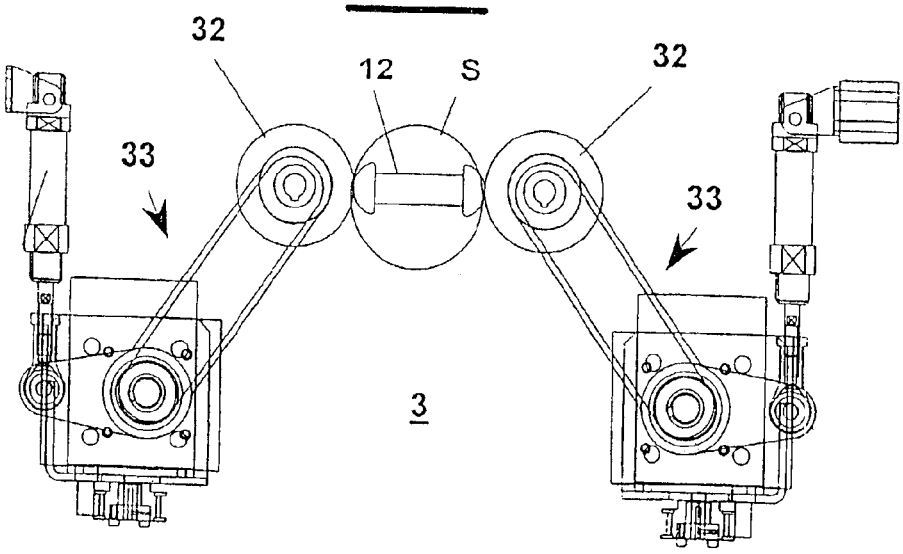
FIG. 5 is a detailed top plan view of the rollers for positioning the sock on the elongated support.

By tangential rollers 32 (FIG. 5) operated by a transmission unit 33, the sock S is rotated axially so that the inflated foot P (FIGS. 2 and 3), which in part protrudes radially, is detected by a photocell (non shown) and stopped in a predetermined angular position, whichever is its starting position. Then, this angular position is recorded in order to bring the sock to the correct position in the following loading step on the forms.

Figure 6:
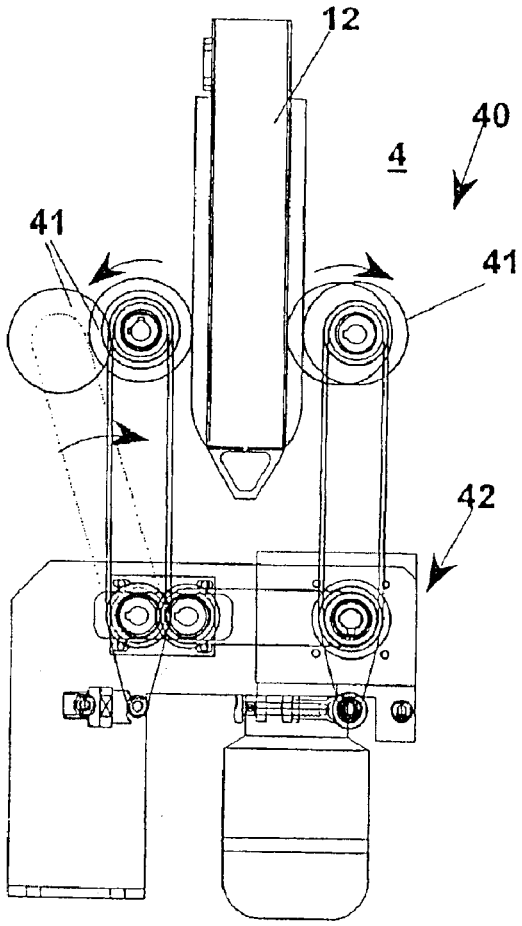
FIG. 6 is a detailed view of the tucking up station of the apparatus of FIG. 1.
Figure 7:
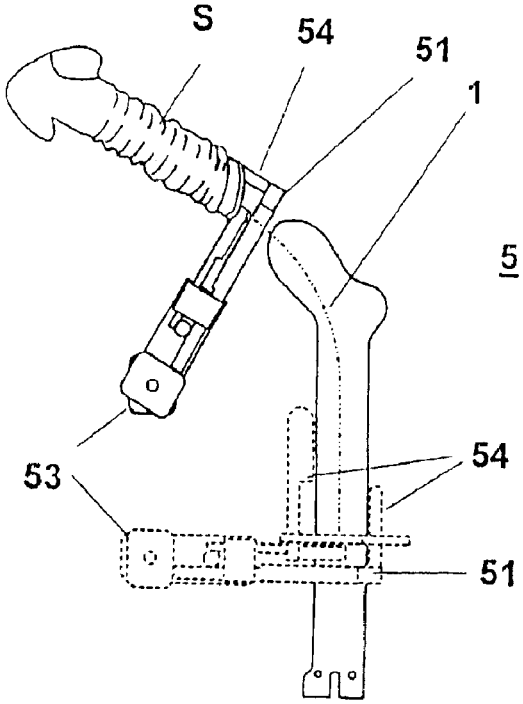
FIG. 7 is an elevational enlarged view of a robot for withdrawing and loading on the steaming forms the positioned socks with illustration of some operative steps.

After the positioning station, the socks are tucked up at station 4 (FIGS. 1,2 and 6) by means of a tucking up unit 40. More precisely, sock S is further put onto the elongated supports 12, so that foot P is at least about completely put on them and does not hang towards below. Unit 40 provides a couple of rollers 41 that can approach elongated support 12 up to contacting the sock on it and rotating, by means of a actuating device 42, thus tucking up the sock S.

Among the tucking up station 4 and the withdrawing and loading station 5 the elongated supports 12 rotate of 180° with respect to an horizontal axis, so that the sock has foot or tip towards the above and can be loaded on forms 1 oriented towards the above.

The withdrawing step from elongated support 12 and the loading step are carried out at station 5 (FIG. 2) by means of a robotized unit 50 formed by two arms 51 opposite 180° to each other and mounted on an upright guide 52 rotatable about its own vertical axis. Arms 51 can translate vertically on a carriage 53 upwards or downwards along upright guide 52 and can rotate about an horizontal axis. At their ends arms 51 have withdrawing fingers 54 capable of entering between the, sock and the elongated support, of widening them and then, carried towards the above by the arms same, of withdrawing the sock from elongated support 12. Then, the upright guide 52 rotates of 180° with respect to its own vertical axis and the sock, widened by fingers 54, can be loaded onto steaming forms 1 by means of the rotation about an horizontal axis of the arm and a contemporaneous translation towards below of carriage 53.

Figure 12:
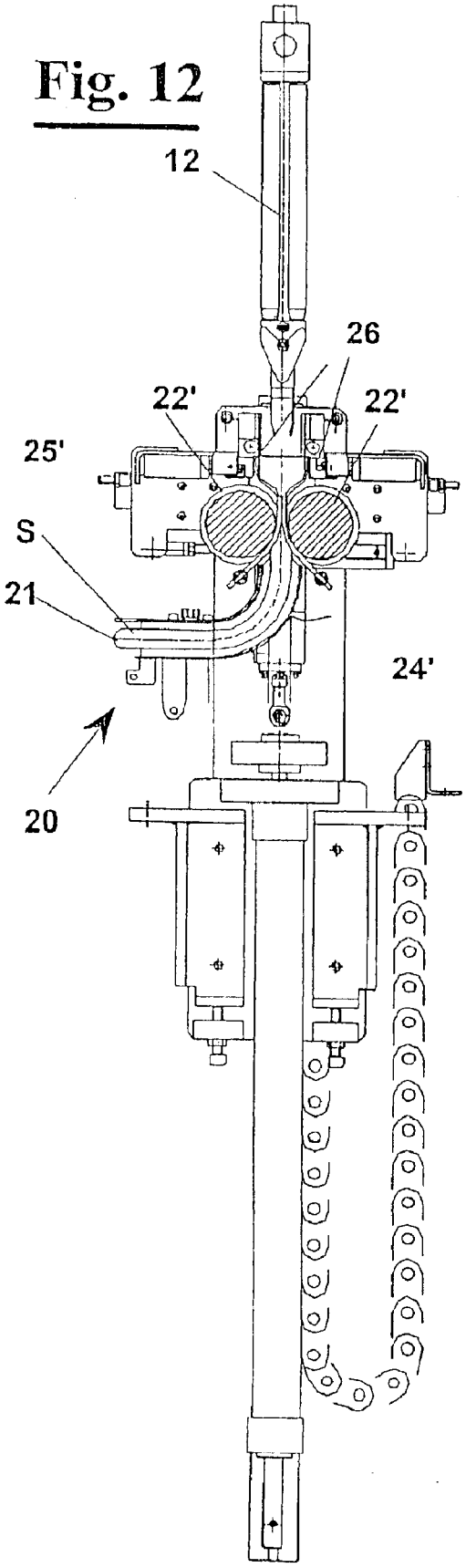
Figure 11:
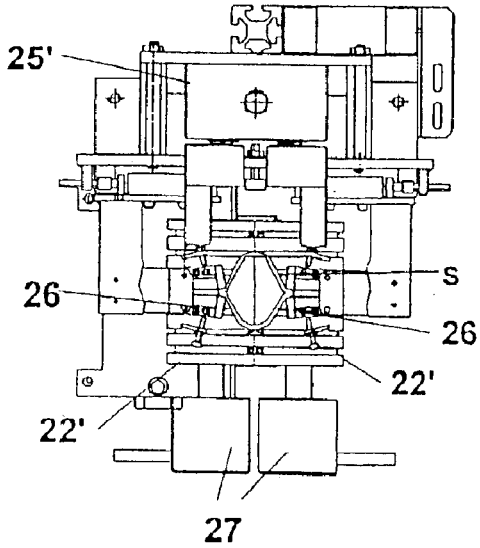
Figure 13:
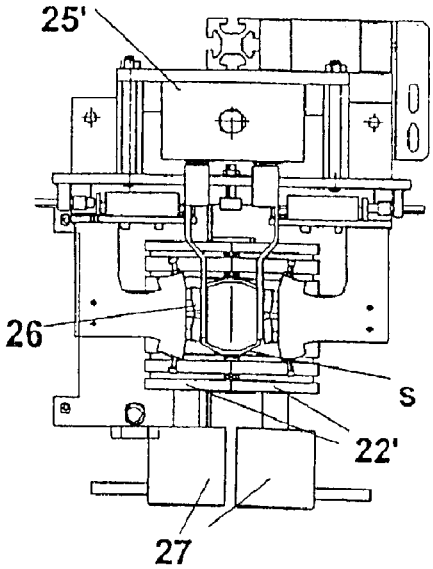

According to a different embodiment of the invention, with reference to FIGS. from 8 to 15, the step of opening and putting sock S onto elongated supports 12 can be done by means of tweezers 26 mounted on a carriage 25' slidable towards the above on an upright guide 24'. Tweezers 26 are positioned open when they are waiting to receive sock S that comes from suction duct 21 by means of splined and rubber coated rollers 22' operated by axes controlled motors 27 (FIGS. 8, 9). Tweezers 26 have jaws arranged about tangential with respect to the sock and are closed and pulled after having touched the sock in order to open the elasticised open edge (FIGS. 10, 11). If the opening step fails, for example because the sock is not correctly oriented and the tweezers fail to open the foot or tip, the jaws loose the grip without tearing the sock, which can be delivered back by reversing the rotation of rollers 22', and are then put forward again oriented correctly. Then, as shown in FIGS. 12 and 13, the carriage 25' moves upwards carrying with it the sock and putting it on elongated support 12. Once reached the top position along upright guide 24' (FIGS. 14 and 15) the tweezers open again and release the sock on elongated support 12 and go back to the position of FIG. 8 thus allowing a rotation of elongated support 12 to the next positioning station 3.

The machine with several stations described above is completely different from that described according to the prior art and allows a remarkable reduction of the cycle time with respect to the existing system.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. A method for opening, positioning, loading on forms socks, knee socks and the like, comprising a step of widening the socks, a step of introduction of the open socks on an elongated support, a step of positioning the foot of the socks, and a step of putting on fixed forms the positioned socks, characterised in that a first sock arranged on a first elongated support, after said positioning step in a positioning station, is brought to a withdrawing station for said loading step on forms, whereby in said positioning station the positioning step of a second sock on a second elongated support can be carried out.

2. Method according to claim 1, wherein said second sock, after having been widened in said widening step and put on said second elongated support in a station of entry, is brought to said positioning station, whereby in said station of entry a third elongated support comes on which a third sock can be put.

3. Method according to claim 1, wherein at the end of said positioning step the sock has foot that hangs towards below from said elongated support, before said withdrawing step for loading the sock onto said forms a step of tucking up said sock on said elongated support being provided, as well as a step of rotation is provided of said elongated support about an horizontal axis for bringing the foot of the tucked up sock oriented towards the above.

4. Method according to claim 1, wherein said widening step of said socks is carried out by means of passage through a couple of suction counter rotating rollers, further to said passage said socks having a widened elasticised edge that is drawn and put on said elongated support.

5. Method according to claim 4, wherein said suction rollers widen said sock conveying it from below towards the above, whereby said elongated support on which said sock is put on is oriented vertically towards below.

6. Method according to claim 1, wherein in said withdrawing station said first sock just positioned is widened, is withdrawn automatically away from said elongated support, is brought to a loading station and put on a form, whereby said second sock that in the meanwhile is brought to said withdrawing station after having been positioned can be in turn withdrawn thus freeing said second elongated support.

7. Method according to claim 1, wherein in said withdrawing station said sock is positioned with foot oriented towards the above, a movement of withdrawing it from below towards the above as well as a movement of widening and a movement of rotation of said sock about an horizontal axis being provided for then putting it on said form.

8. An apparatus for opening, positioning, loading on forms socks, knee socks and the like, comprising means for widening the socks, means for introduction of the open socks on an elongated support, means for positioning the foot of the socks, and means for putting the positioned socks on fixed forms, characterised in that it comprises:

at least a first and a second elongated support connected to a carousel having at least two stations, and means for rotating said carousel thus carrying said elongated supports through said stations, in one station means being provided for widening and withdrawing said sock from said elongated support AND for loading it on a form, whereas in the other station means are provided for axial positioning the sock.

9. Apparatus according to claim 8, wherein said carousel comprises at least a third elongated support and a third station, said carousel carrying said elongated supports in respective stations wherein means for widening and putting said sock on said elongated support, means for axial positioning the sock, and means for withdrawing said sock and loading it on a form are respectively provided.

10. Apparatus according to claim 8, wherein said means for widening comprise widening rollers that carry said socks from below towards the above, whereby said carousel brings above said rollers said elongated supports that are oriented towards below, whereby said elongated supports in said station at entry can be vertical and their rotation from horizontal to vertical is not necessary.

11. Apparatus according to claim 10, wherein said means for widening comprise counter rotating suction widening rollers, whereby when passing through them the elasticised open edge of said socks is widened.

12. Apparatus according to claim 10, wherein said means for widening comprise a couple of tweezers facing each other that open and grip the elasticised open edge of the sock and bring the sock towards the above putting it on the elongated support, that is arranged in co-axial position.

13. Apparatus according to claim 12, wherein means are provided for detecting a failed grip of a sock by the tweezers in case the sock is not oriented correctly with foot located instead of the elasticised open edge, means being provided responsive to said means for detecting for leading back said sock and for orienting it correctly.

14. Apparatus according to claim 8, wherein said carousel comprises means for rotating said elongated supports substantially 180° with respect to an horizontal axis before reaching said means for withdrawing.

15. Apparatus according to claim 8, wherein after said positioning station means are provided for tucking up said socks on said elongated supports.

16. Apparatus according to claim 15, wherein said means for tucking up comprise tangential friction rollers that are selectively carried against the socks present on said elongated supports in a tucking up station.

17. Apparatus according to claim 8, wherein said means for withdrawing the sock away from the elongated support and for loading it on forms comprise a robotized equipment formed by at least two arms opposite 180° to each other and mounted on an upright guide rotatable about a vertical axis.

18. Apparatus according to claim 17, wherein said arms comprise means for translating vertically upwards or downwards along said upright guide and means for rotation about an horizontal axis.

19. Apparatus according to claim 18, wherein said arms have at the end withdrawing fingers, said means for translating bringing said withdrawing fingers between said sock and said elongated support, means being provided for widening said fingers during the steps of withdrawing and loading and then for approaching them at the end of said loading step.

* * * * *